US011512930B2

(12) United States Patent
Cohen

(10) Patent No.: US 11,512,930 B2
(45) Date of Patent: Nov. 29, 2022

(54) REACTIVE ARMOR

(71) Applicant: David Cohen, Herzliya (IL)

(72) Inventor: David Cohen, Herzliya (IL)

( * ) Notice: Subject to any disclaimer, the term of this patent is extended or adjusted under 35 U.S.C. 154(b) by 0 days.

(21) Appl. No.: 16/762,937

(22) PCT Filed: Oct. 18, 2018

(86) PCT No.: PCT/IL2018/051120
§ 371 (c)(1),
(2) Date: May 10, 2020

(87) PCT Pub. No.: WO2019/092693
PCT Pub. Date: May 16, 2019

(65) Prior Publication Data

US 2020/0278181 A1 Sep. 3, 2020

(30) Foreign Application Priority Data

Nov. 9, 2017 (IL) ..... 255617

(51) Int. Cl.
*F41H 5/007* (2006.01)
*F41H 5/04* (2006.01)

(52) U.S. Cl.
CPC ..... *F41H 5/007* (2013.01); *F41H 5/0492* (2013.01)

(58) Field of Classification Search
CPC ..... F41H 5/007; F41H 5/0492
USPC ..... 89/36.02
See application file for complete search history.

(56) References Cited

U.S. PATENT DOCUMENTS

| | | | | |
|---|---|---|---|---|
| 3,893,368 | A | 7/1975 | Wales, Jr. | |
| 4,051,763 | A | 10/1977 | Thomanek | |
| 4,665,794 | A | 5/1987 | Gerber et al. | |
| 5,577,432 | A | 11/1996 | Becker et al. | |
| 5,824,941 | A | 10/1998 | Knaepper | |
| 8,020,483 | B2 | 9/2011 | Benyami et al. | |
| 9,797,690 | B1 | 10/2017 | Warren | |
| 2006/0107829 | A1 | 5/2006 | Shumov et al. | |
| 2018/0017358 | A1* | 1/2018 | Cohen | F41H 5/007 |
| 2018/0299229 | A1* | 10/2018 | Cohen | F41H 5/007 |

FOREIGN PATENT DOCUMENTS

| | | | | |
|---|---|---|---|---|
| AU | 2016341368 | A1 * | 5/2018 | F41H 5/04 |
| DE | 3636945 | | 4/2004 | |
| FR | 2380528 | | 9/1978 | |
| WO | WO 2016/135724 | | 9/2016 | |
| WO | WO 2019/092693 | | 5/2019 | |

OTHER PUBLICATIONS

International Preliminary Report on Patentability dated Mar. 26, 2020 From the International Preliminary Examining Authority Re. Application No. PCT/IL2018/051120. (18 Pages).
International Search Report and the Written Opinion dated Jan. 31, 2019 From the International Searching Authority Re. Application No. PCT/IL2018/051120. (16 Pages).
(Continued)

*Primary Examiner* — Jonathan C Weber

(57) ABSTRACT

A reactive armor unit has a first explosion center and a second explosion center, the unit being configured with a predetermined distance between the first and the second explosion centers.

18 Claims, 13 Drawing Sheets

(56) References Cited

OTHER PUBLICATIONS

Invitation to Pay Additional Fees dated Feb. 16, 2020 From the International Preliminary Examining Authority Re. Application No. PCT/IL2018/051120. (2 Pages).
Supplementary European Search Report and the European Search Opinion dated Sep. 14, 2021 From the European Patent Office Re. Application No. 18876663.8. (14 Pages).
Examination Report Under Sections 12 & 13 of the Patents Act, 1970 and the Patents Rules, 2003 dated Jun. 28, 2022 From the Government of India, Intellectual Property India, Patents, Designs, Trade Marks, Geographical Indications, The Patent Office Re. Application No. 202027023354. (6 pages).

* cited by examiner

REACTIVE ARMOR

RELATED APPLICATIONS

This application is a National Phase of PCT Patent Application No. PCT/IL2018/051120 having International filing date of Oct. 18, 2018, which claims the benefit of priority of Israel Patent Application No. 255617 filed on Nov. 9, 2017. The contents of the above applications are all incorporated by reference as if fully set forth herein in their entirety.

FIELD AND BACKGROUND OF THE INVENTION

The present invention, in some embodiments thereof, relates to active armor and an active armor system and, more particularly, but not exclusively, to reactive armor that is intended to defeat tandem missiles.

Since tanks were first used in the First World War, there has been a race between armor and armor piercing technology. The first tanks were bullet proof but vulnerable to high explosive artillery shells. Subsequent tanks were more heavily armored and dedicated armor piercing artillery rounds and anti-tank guns started to appear.

Towards the end of the Second World War, hand held weapons in the form of the bazooka used shaped charges to produce a high pressure region to break through the armor. A typical modem shaped charge, with a metal liner on the charge cavity, can penetrate steel armor to a depth of seven or more times the diameter of the charge (charge diameters, CD), though greater depths of CD and above have been achieved. Contrary to a widespread misconception the shaped charge does not depend in any way on heating or melting for its effectiveness; that is, the jet from a shaped charge does not melt its way through armor, as its effect is purely kinetic in nature. The resulting munition, known as a high energy anti-tank (HEAT) round, can be launched from an anti-tank gun or rocket launcher.

In order to defeat a HEAT round, the tank may be equipped with explosive reactive armor (ERA) elements, that are attached on the outside of the tank.

The ERA typically consists of two angled metal plates with a layer of high explosive in between. The ERA detonates, forcing the plates outward towards the incoming missile. The angle of the plates together their velocity change the fundamental statistics of the incoming missile, disrupting the impact of the jet. More particularly, the jet is forced to cut through a long length of metal plate coming towards the jet at high speed, and expends its energy on the reactive armor rather than on the tank itself.

The ERA, once operated, leaves a vulnerable location on the tank, but the adversary has to hit the exact same location on the tank armor a second time in order to take advantage. In response, the HEAT rounds have been superseded by the Tandem Charge. The Tandem Charge round includes two or more stages of detonation. A first detonation sets off the ERA and gets it out of the way, and a second detonation further back on the same incoming round applies a shape charge directly to the armor of the tank without disruption by the active armor.

SUMMARY OF THE INVENTION

The present embodiments may provide a reactive armor solution to meet the threat of the tandem warhead.

A reactive armor unit may react to an incoming projectile by providing timed and/or directed explosions that allow the reactive armor to survive the first detonation stage and to disrupt the second detonation.

According to an aspect of some embodiments of the present invention there is provided a reactive armor unit comprising a first explosion center and a second explosion center, the unit being configured with a predetermined distance between the first and the second explosion centers.

Embodiments may include a shield element between the first explosion center and the second explosion center.

In an embodiment, the second explosion center is mounted on a movable element to extend away from the reactive armor unit to a second predetermined distance from the first explosion center.

Embodiments may have a first state in which the second explosive center is extended outwards on the movable element and a second state in which the second explosive center is withdrawn into the reactive armor unit.

Embodiments may comprise a third explosion center at a third predetermined distance from the first explosion center and at a fourth predetermined distance from the second explosion center.

In an embodiment, the third explosion center is mounted on a movable element to extend outwards of the reactive armor unit to a fifth predetermined distance from the first explosion center.

Embodiments may have a third explosion center on the movable element at a sixth predetermined distance along the moving element from the second explosion center.

Embodiments may comprise a trigger mechanism for activation by an incoming warhead, and a delay mechanism configured to define respective predetermined delays to each of the explosion centers.

In an embodiment, at least one of the predetermined delays is selected to ensure that at least one of the explosion centers is timed to explode at a time suitable for disruption of pressure wave formation or structural integrity of a secondary detonation of the incoming tandem missile.

In an embodiment, the delay mechanism comprises one member of the group consisting of: a predetermined length of explosive cord, an electronic timer, a length of high explosive and a tube of high explosive.

In an embodiment, at least one of the predetermined distances is selected to ensure that at least one of the explosion centers is located behind a primary detonation of an incoming tandem missile and in a position suitable for disruption of pressure wave formation or structural integrity of a secondary detonation of the incoming tandem missile.

Embodiments may have a first surface for orientation parallel to armor being protected, wherein the first explosion center comprises first and second sheets of steel placed at an acute angle to the first surface.

Embodiments may have an outer surface following a contour defined by the first and second sheets of steel at the acute angle.

Embodiments may have an outer extension extending from the first surface to accommodate the second explosion center. Embodiments may comprise an opening to allow an explosion center to be extended outwardly therefrom.

One of the explosion centers may have a hemispherical charge. The hemispherical charge may comprise one or more hollow sections. In an embodiment, the hemispherical charge has a metal shell.

In an embodiment, the hemispherical charge comprises a metal shell enclosing the at least one hollow section.

The at least one hollow section may be lined with a metal liner.

In an embodiment, the metal shell comprises a first metal around an outer contour of the charge and the metal liner comprises a second metal different from the first metal.

According to a second aspect of the present invention there is provided a reactive armor unit comprising a first surface for placing flush on armor to be protected and having a plurality of lengths of shaped charges, each length of shaped charge being oriented differently with respect to the first surface.

In an embodiment, the orientations are selected to create a contiguous area of effective defense in front of the unit.

According to a third aspect of the present invention there is provided a reactive armor unit comprising a first explosion center and a second explosion center and a shield element in between the first explosion center and the second explosion center.

In an embodiment, the shield element is positioned to shield the second explosion center from a blast of the first explosion center.

According to a fourth aspect of the present invention there is provided a reactive armor unit having a first surface for orientation parallel to armor being protected, and a first explosion center comprising sheets of steel placed at an acute angle to the first surface, the reactive armor unit further having an outer facing surface following a contour defined by the sheets of steel at the acute angle.

According to a fifth aspect of the present invention there is provided a device for producing focused explosions, comprising:

a rigid outer shell; and an explosive filling, the explosive filling comprising a plurality of inwardly extending hollows.

In an embodiment, the inwardly extending hollows are symmetrical along an axis extending into the explosive filling, and/or are cone-shaped.

In an embodiment, the explosive filling is covered with an outer coating, the coating extending into the inwardly extending hollows.

In an embodiment, the outer coating comprises electroplating.

In an embodiment, the outer coating comprises one member of the group consisting of copper and aluminum and alloys.

In an embodiment, the rigid outer shell comprises one member of the group consisting of metal and ceramics.

In an embodiment, the rigid outer shell comprises aluminum.

Devices may include a detonation point, and in embodiments, the detonation point is equidistant from an apex of each one of the hollows, and/or is angularly aligned with respective axes of symmetry of each of the hollows.

Herein, all references to steel sheet or steel plate refer to sheets or plates of any metal or composite materials with ballistic stopping capabilities.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced. In the drawings:

FIG. 10D is a variation in which the second explosion center is dispensed with;

DESCRIPTION OF SPECIFIC EMBODIMENTS OF THE INVENTION

Figure 1:
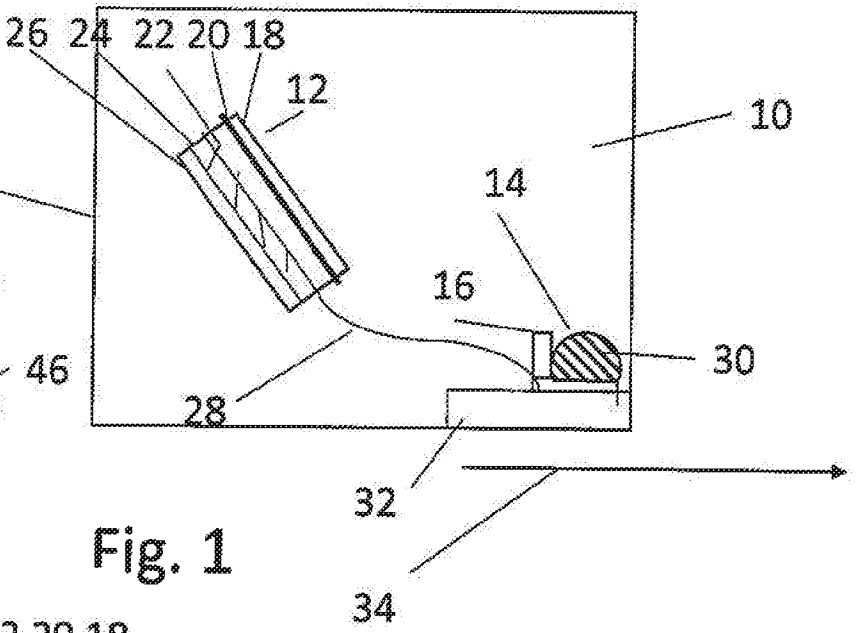
FIG. 1 is a simplified cross-section of an ERA according to an embodiment of the present invention.
Figure 4:
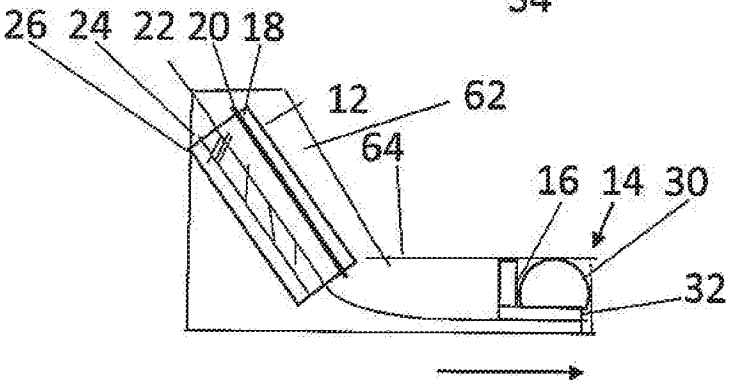
FIG. 4 is a simplified cross-section of an ERA according to a yet further embodiment of the present invention.

The present invention, in some embodiments thereof, relates to active armor and an active armor system and, more particularly, but not exclusively, to reactive armor that is intended to defeat tandem missiles.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring now to the drawings, FIG. 1 illustrates a reactive armor unit 10 having a first explosion center 12 and a second explosion center 14. A predetermined distance is set up between the first and the second explosion centers so that the second explosion center is located behind the initial detonation of an incoming tandem warhead.

A shield element 16 is located between the first explosion center 12 and the second explosion center 14. The purpose of the shield element is to ensure that two independent blasts are created that operate in different directions and that the two blasts do not seriously interfere with each other.

The first explosion center comprises an assembly 16 made up of a first steel plate 18 followed by a detonator 20. Behind the detonator is a second steel plate 22, a layer of explosive 24 and a third steel plate 26. The assembly is at an acute angle to the horizontal.

Connection 28 connects the detonator to the second explosion center 14. The second explosion center has a rounded charge 30 and is located on a movable element 32 which allows it to be extended in the direction of arrow 34. The extended position may be assumed as the armored vehicle requiring protection enters the battle zone, the arm being retracted at other times. Thus the reactive armor has an active or battle-ready state in which the second explosive center is extended outwards on the movable element and a second, passive, state in which the second explosive center is withdrawn into the reactive armor unit 10. The second explosion 15 center could be extended outwardly horizontally or vertically or in any other direction as desired.

The unit is provided inside a rectangular casing 36 which is placed flush against the armor to be protected.

Figure 2:
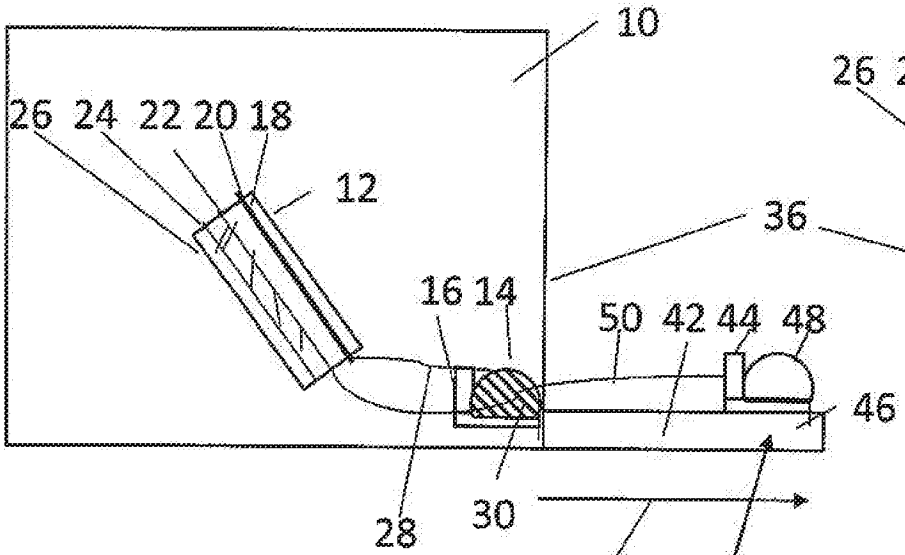
FIG. 2 is a simplified cross-section of another ERA according to an embodiment of the present invention.

Reference is now made to FIG. 2, which is a simplified drawing showing a variation of the unit of FIG. 1 in which there is a third explosion center 40. The third explosion center is on moving arm 42, and is here shown extended outside of casing 36 in the direction of arrow 34. The third explosion center 40 consists of shield 44, base 46 and hemispherical explosive 48. The third explosion center is detonated using trigger wire 50 and is located at fixed distances from each of the first 12 and second 14 explosion centers. The fixed distances may be different when one or both of the second and third explosion centers are extended outwardly of the casing.

The detonator 20 includes a trigger mechanism for activation by an incoming warhead, and there is additionally provided a delay mechanism to define respective predetermined delays to each of the explosion centers, so that each explosion center 30 detonates at a time calculated to cause maximal disruption to a specific part of an incoming tandem warhead. Thus, one of the delays may ensure that a specific explosion center explodes at the exact moment to cause maximal disruption to pressure wave formation of the secondary detonation of the incoming tandem missile.

Figure 14A:
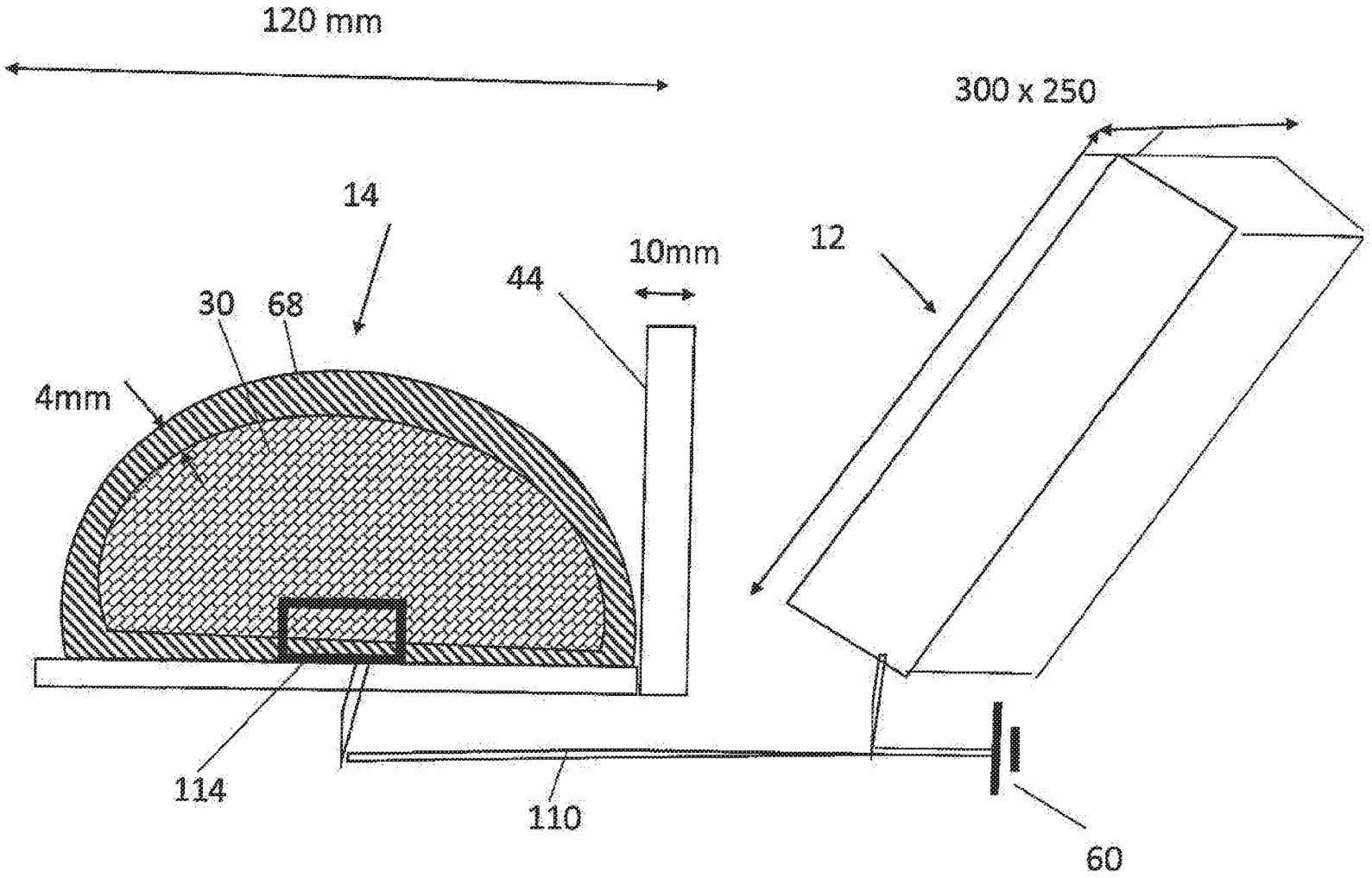
FIG. 14A shows m greater detail the first and second explosion centers according to an embodiment of the present invention.
Figure 14B:
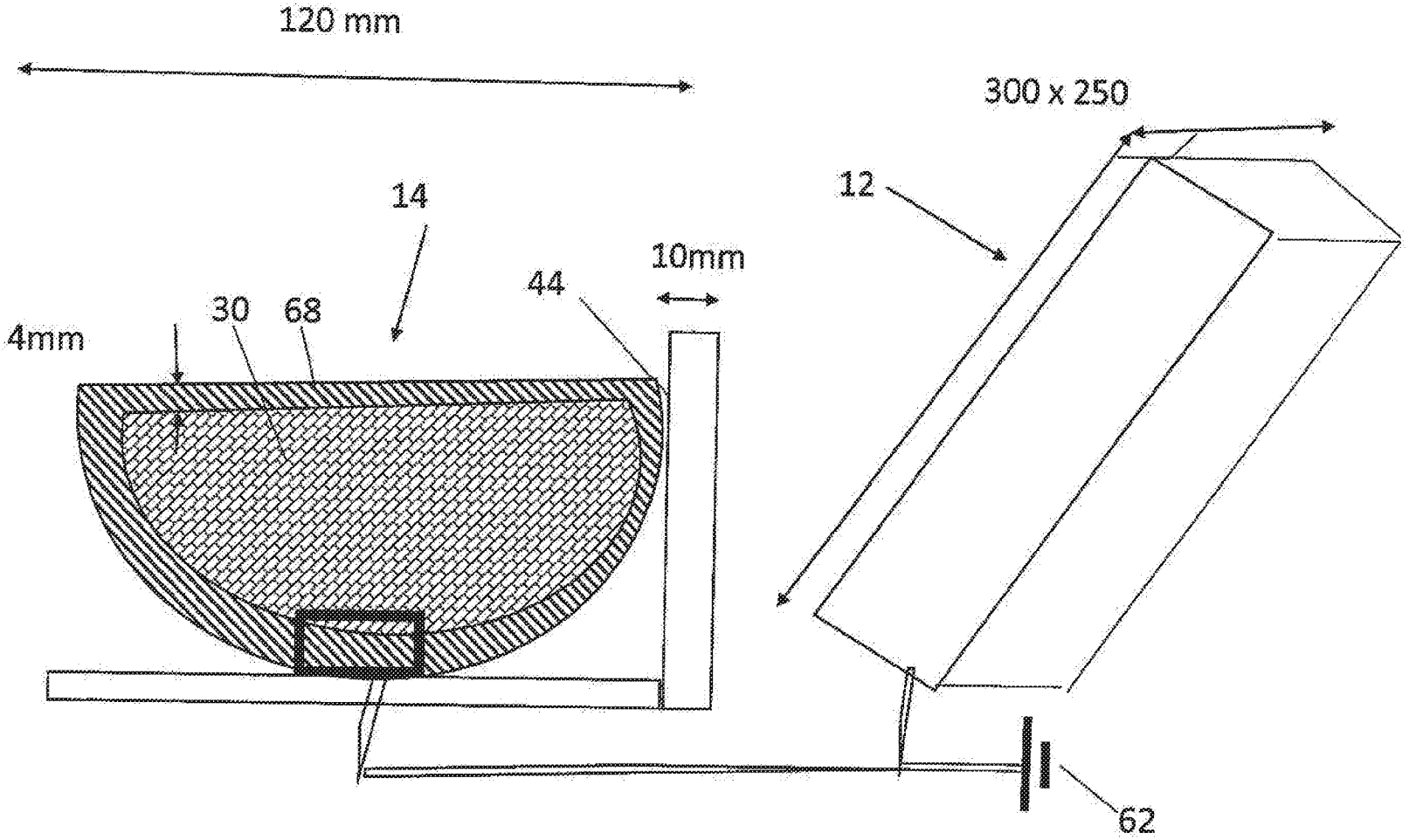
FIG. 14B shows a variation of the embodiment of FIG. 14A in which the explosive hemisphere in the second explosive center is inverted.
Figure 16:
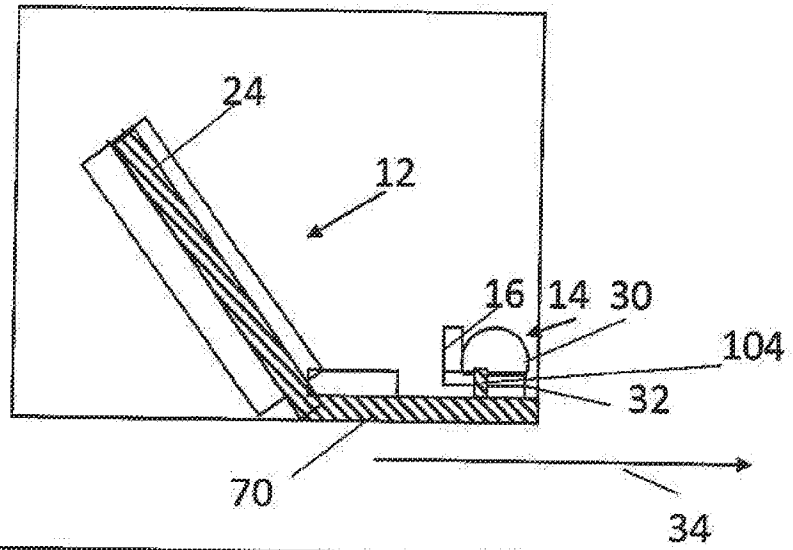
FIG. 16 shows an alternative embodiment in which explosive is used to link between the first and second explosion centers according to an embodiment of the present invention.
Figure 18:
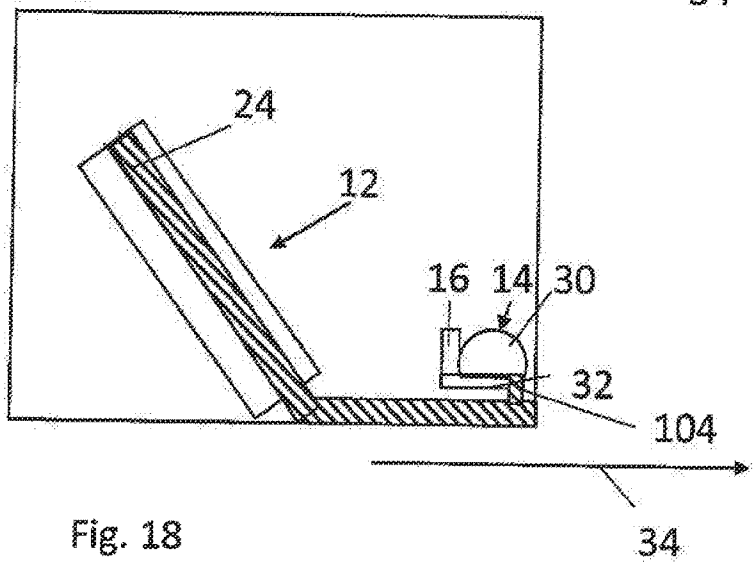
FIG. 18 shows an embodiment in which explosive is used to link between the first and second explosion centers according to a variation of the geometry shown in FIGS. 15 to 17.
Figure 15:
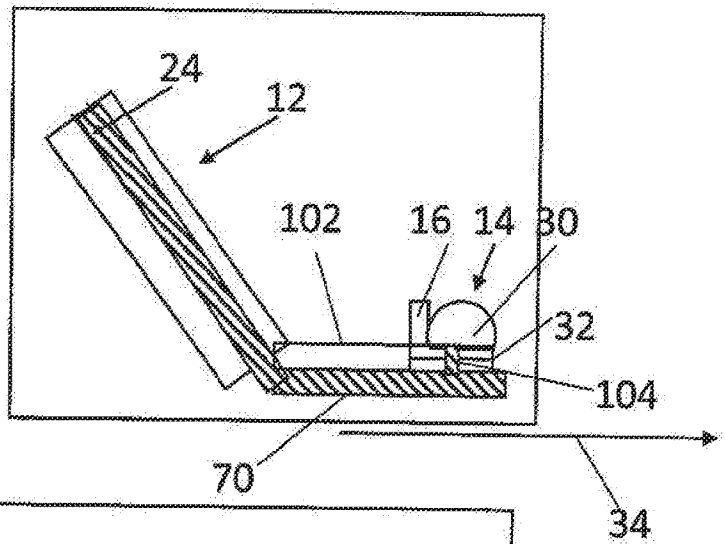
FIG. 15 shows an embodiment in which explosive is used to link between the first and second explosion centers according to an embodiment of the present invention.
Figure 17:
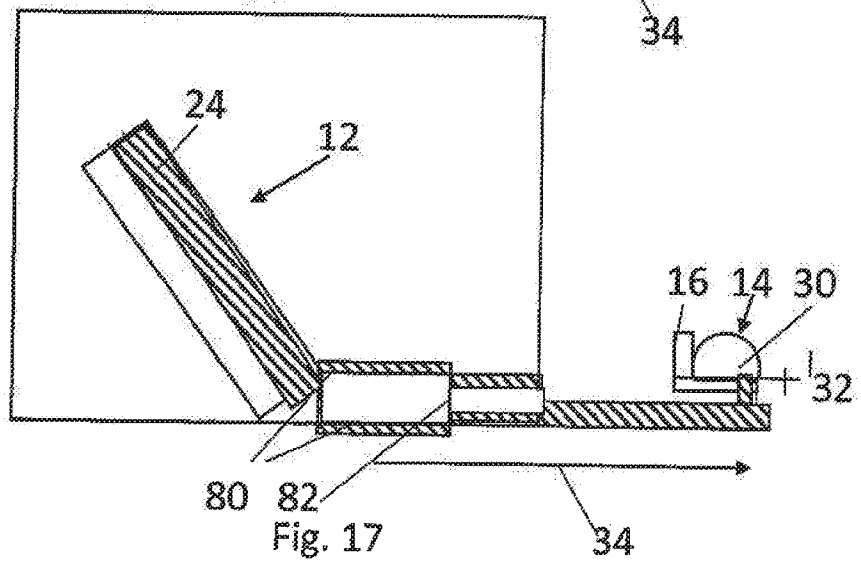
FIG. 17 shows an embodiment in which explosive is used to link between the first and second explosion centers over a telescoping arm according to an embodiment of the present invention.

The delay mechanism may be based on a set length of explosive cord such as cord 28 in FIG. 1. The delay mechanism may be an electronic timer such as based on a battery 60 as shown in FIGS. 14A and 14B. The delay mechanism may alternatively be a length of high explosive 70 as shown in FIGS. 15 and 16, or a tube of high explosive 80 built around telescoping parts of moving arm 82, as shown in FIG. 17.

The use of a set distance, and where necessary a moving arm to reach that distance, may be to ensure that one of the explosion centers is located behind a primary detonation of the incoming tandem missile and in a position suitable for disruption of pressure wave formation of a secondary detonation of the same incoming tandem missile. The distance, together with the shield and the timing, may ensure that the blast disrupting the secondary detonation is not interfered with either by the primary explosion of the active armor, nor by the primary detonation of the incoming tandem missile.

The reactive armor unit is placed flush on the surface of the armor to be protected and has an inside surface which is placed directly in contact with the armor of the tank. The first explosion center 12 is made up of sheets of steel as discussed, and these are placed at an acute angle to the inside surface.

In FIGS. 1-4, there are shown the initial steel plate 18, a spark wire and triggering mechanism 20, a first steel plate 22, an explosive layer 24 and a second steel plate 26. The order of these parts as described above is varied in subsequent figures.

Figure 3:
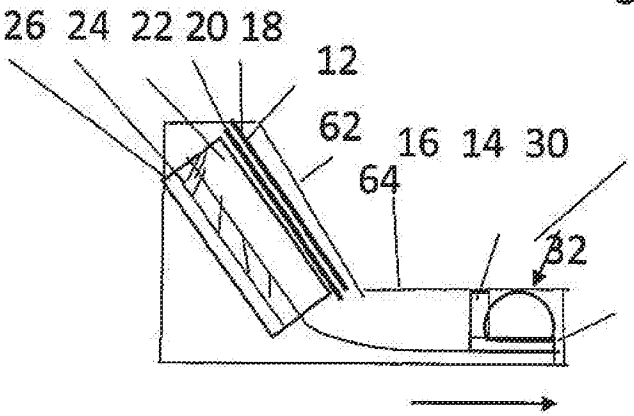
FIG. 3 is a simplified cross-section of an ERA according to a further embodiment of the present invention.
Figure 6:
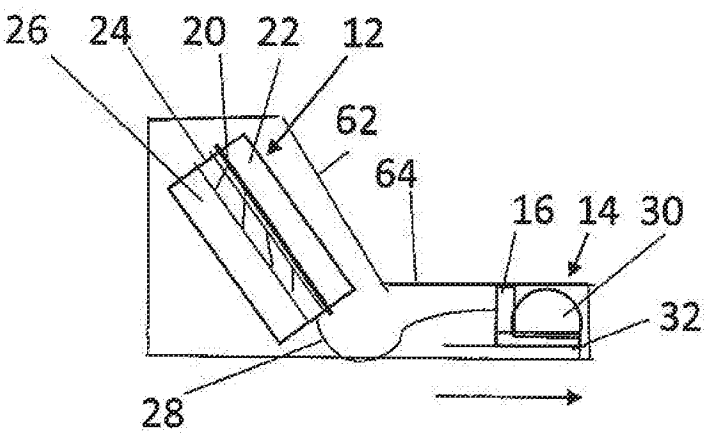
FIG. 6 is a simplified cross-section of an ERA according to a yet further embodiment of the present invention.
Figure 5:
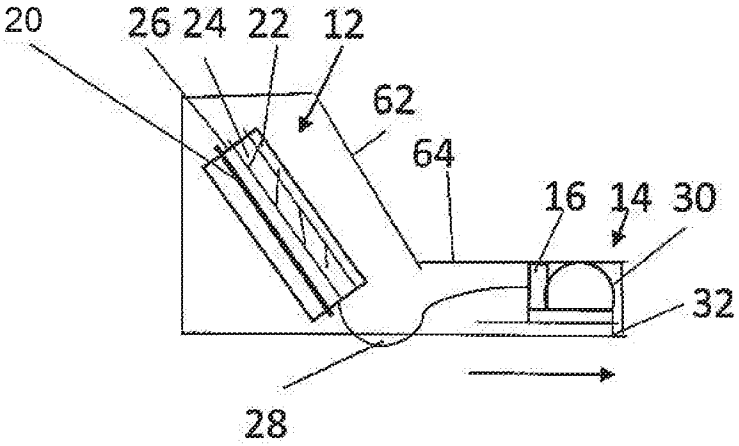
FIG. 5 is a simplified cross-section of an ERA according to a further embodiment of the present invention.

In FIG. 3, the initial steel plate 18 and spark wire are placed at a set distance in front of the first explosion center 12, thereby allowing the possibility of delaying detonation of 25 the first explosive center. The figures may provide different orders of spark wire 20, steel board 18, explosive 24 and the two steel layers 20 and 22. The initial steel layer 18 is not required if the spark wire is placed behind one of the other steel layers, as its purpose is to prevent triggering of the reactive armor by accidental knocks or by bullets or other non-armor threatening ammunition. The spark wire may be placed in front of or behind the explosive. In FIG. 5, the spark wire 20 is placed behind both the steel plates 22 and 26 and the explosive layer 24, and the initial steel plate 18 is dispensed with. In FIG. 6, the spark wire 20 is placed behind the first steel plate 22 and in front of explosive layer 24 and second steel plate 26. Ag~ initial steel plate is dispensed with.

Figure 7:
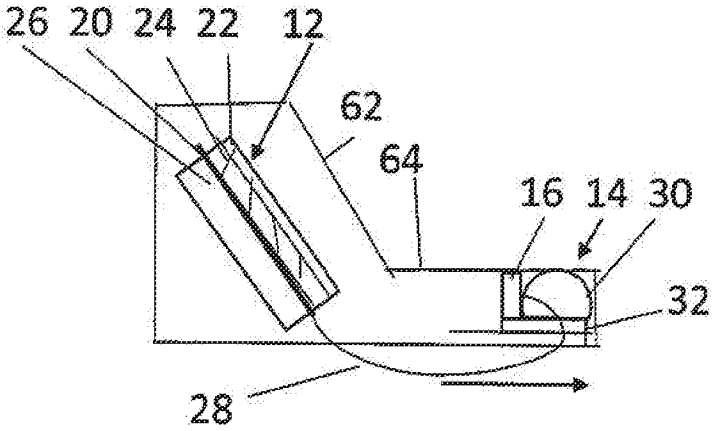
FIG. 7 is a simplified cross-section of an ERA according to another embodiment of the present invention.

In FIG. 7, the spark wire is placed behind the explosive layer 24 and the first steel plate 22 and in front of the second steel plate 26.

As shown in all of FIGS. 3 to 13, in embodiments, the outer facing surface of the reactive armor unit 10 may follow the contour of the angled sheets of steel of the first explosion center to form a sloped part 62 of the unit 10. The unit may further have an outer extension 64 to accommodate the second explosion center at the necessary distance from the first explosion center.

An opening may be provided at the end of extension 64 to allow an explosion center to be extended outwardly when the necessary distance is larger than can be accommodated by the size of the casing.

As will be discussed in greater detail below, an electrical cord, or a detonation cord or a pipe of explosive or a tube of explosive around telescope sections of an extension arm may be used to connect the two explosion centers and ensure that one explodes with a preset delay after the other.

Figure 8A:
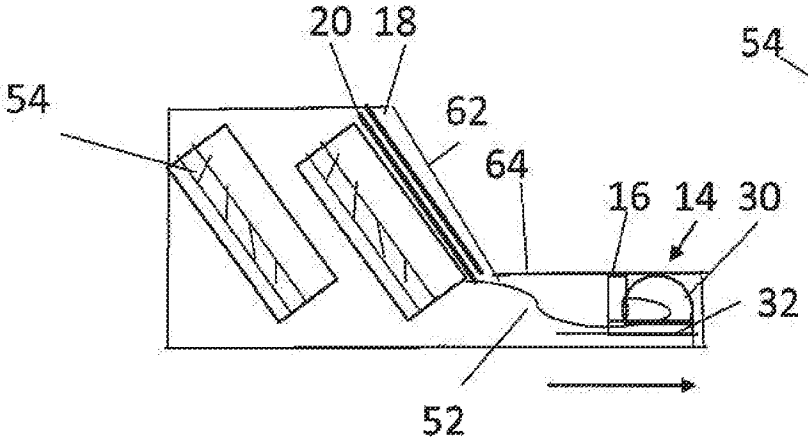
FIG. 8A is a simplified cross-section of an ERA having a repeat explosion center according to an embodiment of the present invention.

FIG. 8*a* shows a frontal steel plate 18 and a detonation layer 20 under the plate. The detonation layer is connected to the second explosion center via wire 52. A second repeat version 54 of the first explosion center is located behind the first explosion center and detonates in response to the first explosion center.

Figure 8B:
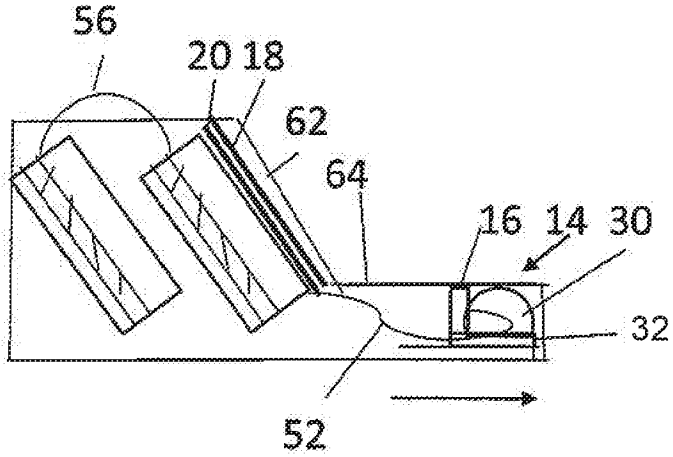
FIG. 8B is a simplified cross-section of another ERA having a repeat explosion center according to an embodiment of the present invention.

FIG. 8*b* is the same arrangement as FIG. 8*a* except that the repeat explosion center is connected via cord 56 to the first explosion center.

Figure 9:
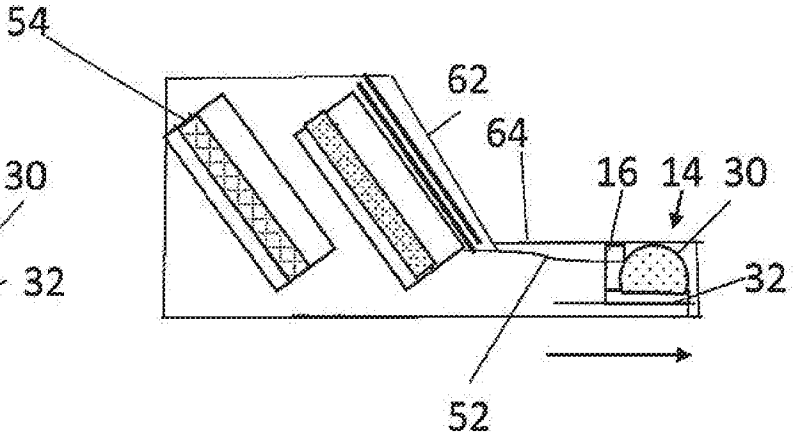
FIG. 9 is a simplified cross-section of a further ERA having a repeat explosion center according to an embodiment of the present invention.

FIG. 9 is the same as FIG. 8*a* except that the repeat explosion center 54 uses a slower explosive than the first explosion center 12. Alternatively, the explosives may be reversed so that the first explosion center has a slower explosive than the repeat explosion center. The second explosion center has an explosive whose rate is independent of the other two, and the effects may be coordinated to provide a prolonged effect, or to deal with different parts of the incoming projectile, which may be a kinetic penetrator.

Figure 10A:
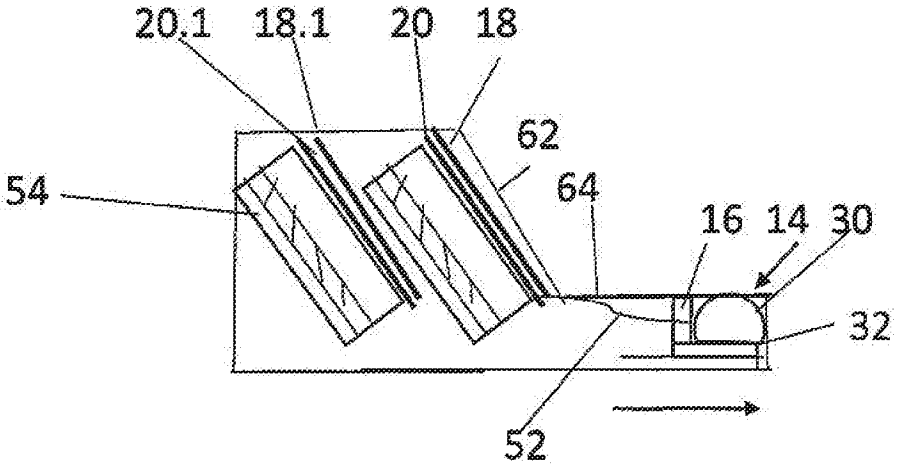
FIG. 10A is a simplified cross-section of a yet further ERA having a repeat explosion center according to an embodiment of the present invention.

FIG. 10A has a shield 18.1 and trigger 20.1 over the repeat explosion center 54 so that the repeat explosion is controllably triggered by the first explosion. FIG. 10B has a pipe of explosive 63 connecting between the first explosion center and the repeat explosion center. In an embodiment, the pipe may be made of fast explosive. The embodiment may be provided with or without triggering screen 20, or the triggering screen may be in a different location in accordance with the various embodiments herein.

Figure 10C:
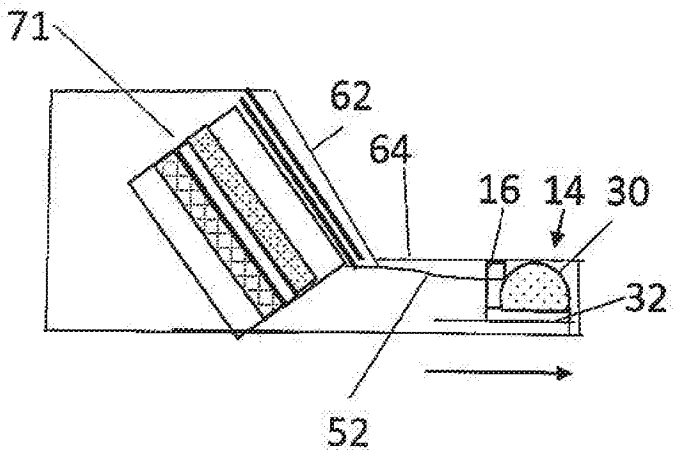
FIG. 10C is a variation in which the first explosion center has multiple explosive layers.

Reference is now made to FIG. 10C, which shows a modification 71, of the first explosion center, in which a first sheet of steel is followed by a first explosive layer, followed by a second sheet of steel followed by a second layer of explosive and a third sheet of steel. The two explosive layers may be of the same or different explosive material, having different explosion rates or quantities of explosive. Thus the sheets of steel may be ejected at different rates, again causing a prolonged effect. The quantity or speed of the different layers of explosive allow the effect to be designed as needed.

Figures 23A, 23B:
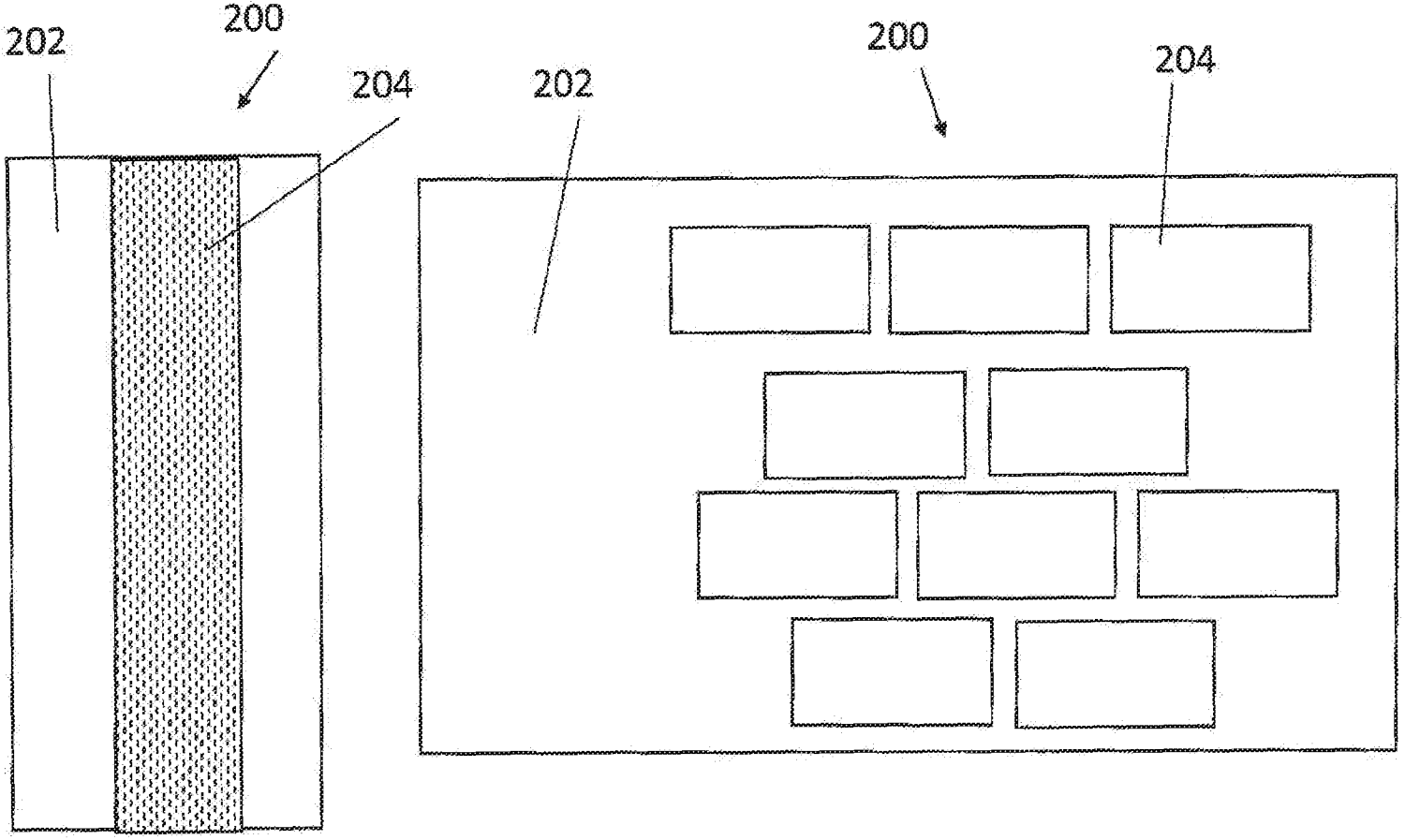
FIGS. 23A and 23B are lateral and longitudinal cross-sections of a plate that may be used in the present embodiments.

It is appreciated that two layers are merely exemplary, and any number of layers may be provided, and the gaps in between may be filled with steel or any other metal or composite, for example as shown in FIG. 23A and B, or may even be empty space.

Figure 10D:
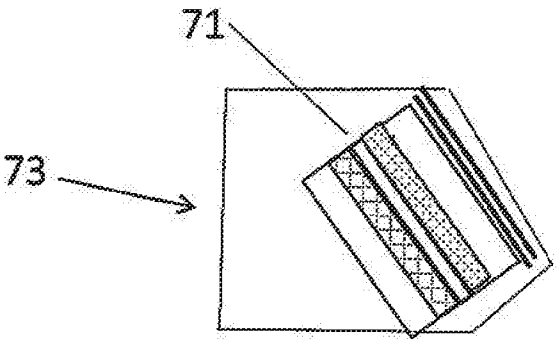
Figure 10B:
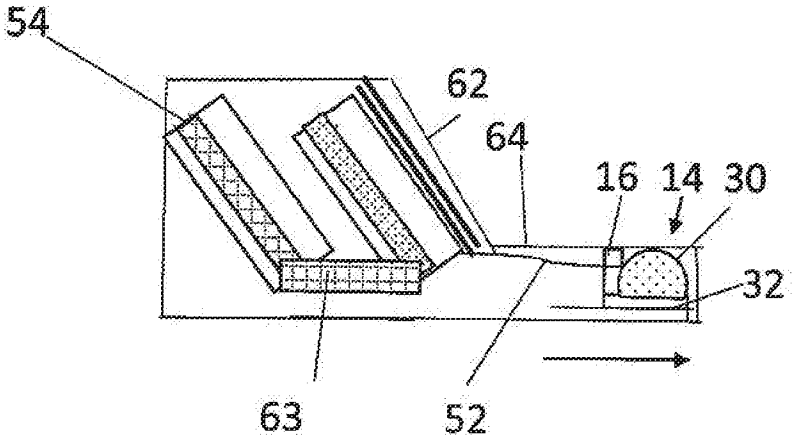
FIG. 10B is a variation in which the repeat explosion center is connected via an explosive pipe.

Reference is now made to FIG. 10D, which is a simplified diagram showing a variation of the ERA module of FIG. 10C in which the second explosion center is dispensed with. First explosion center 71 again comprises a first sheet of steel, which is followed by a first explosive layer, followed by a second sheet of steel followed by a second layer of explosive and a third sheet of steel. The two explosive layers may be of the same or different explosive material, having different explosion rates or quantities of explosive. Thus the sheets of steel may be ejected at different rates, again causing a prolonged effect. The quantity or speed of the different layers of explosive allow the effect to be designed as needed.

As before, the two layers are merely exemplary, and any number of layers may be provided, and the gaps in between may be filled with steel or any other metal or composite, for example as shown in FIG. 23A and B, or may even be empty space.

Figure 12:
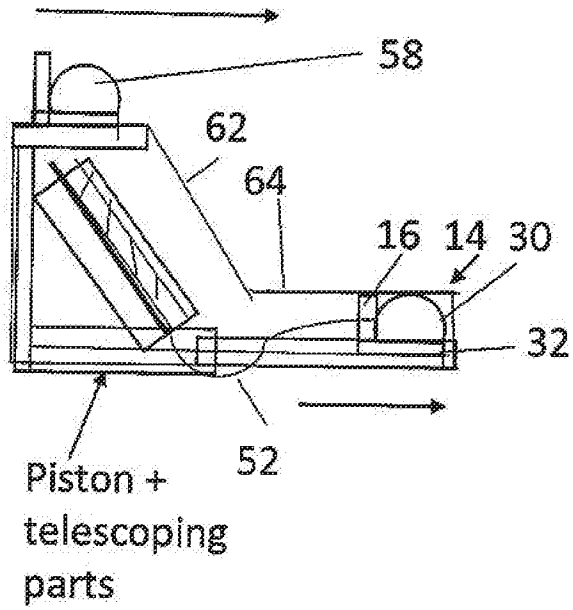
FIG. 12 is simplified cross-section of another ERA having a third explosion center according to an embodiment of the present invention.
Figure 11:
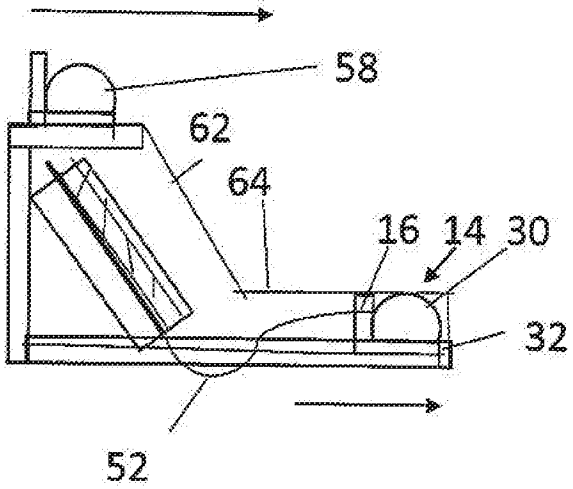
FIG. 11 is a simplified cross-section of an ERA having a third explosion center according to an embodiment of the present invention.
Figure 13:
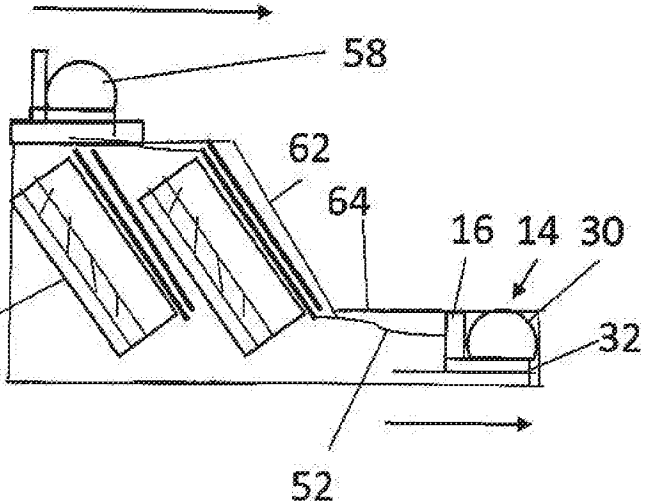
FIG. 13 is simplified cross-section of another ERA having both a repeat explosion center and a third explosion center according to an embodiment of the present invention.

FIGS. 11-13 illustrate different embodiments in which a third explosion center 58 is placed at the far end of the ERA 10 from the second explosion center 14. FIG. 11 shows the two explosion centers at preset distances from the first explosion center.

FIG. 12 shows the second explosion center on a telescoping arm 59. A piston may operate the telescoping arm. The arm may be extended as the vehicle enters dangerous territory and retracted as the vehicle returns to base.

FIG. 13 shows an embodiment with a repeat explosion center 54. Other combinations of the present embodiments will be understood by the skilled person. For example the third, and/or subsequent explosion centers may also be mounted on a movable arm or arms, and may be moved to another point for use. One position may be within the shielding of the ERA and the other position may be outside, and elements around the third explosion center may provide shielding from the blasts of the other two centers.

The second and subsequent explosion centers may comprise a hemispherical charge 30, which is shown in greater detail in FIG. 14A, although the hemisphere may be inverted as shown in FIG. 14B.

As shown in FIGS. 14A and 14B, shield 44 separates the domains of the two explosion centers so that the blasts do not interfere with each other and blasting cord 110 links the second explosion center 14 to the blast cord trigger and to battery 60.

First explosion center 12 may be supported in its angled position by filler 112 which may be for example polystyrene. The blasting cord is connected to blast booster 114 which detonates charge 30. Charge 30 may be encased in metal casing 68. A typical thickness for the casing is 4 mm, for the shield is 10 mm and the second explosion center may be 120 mm in length. The construction for the primary explosion center is typically 300×250 mm and the distance between the first and second explosion centers may be varied.

Reference is now made to FIGS. 15-18 which show methods of causing timed primary and secondary explosions at two explosion centers 12 and 14 using the explosive itself to form the timed connection. In FIG. 15 the explosive 24 at the first explosion center is connected through a continuous pipe of explosive 70 which goes under steel base 102 to connect via branch 104 of explosive to the second explosion center 14. The diameter of the pipe 100 is chosen to provide a predetermined delay, and the steel base ensures that the ERA retains its geometric integrity between the first and second explosions so that the second explosion occurs in the intended location with respect to the first location. In FIG. 16 the second explosion center has been moved outwards in the direction of arrow 34. In FIG. 17 the second explosion center 14 is held in an extended position outside the confines of the ERA on arm 80 which consists of multiple telescoping parts. Explosive pipe 82 is provided as a lining on the telescoping parts. In FIG. 18 pipe 70 is again terminated with branch 104 leading in to the second explosion center, but the branch 104 is located at the end rather than in the middle, to increase the time delay.

Figure 19:
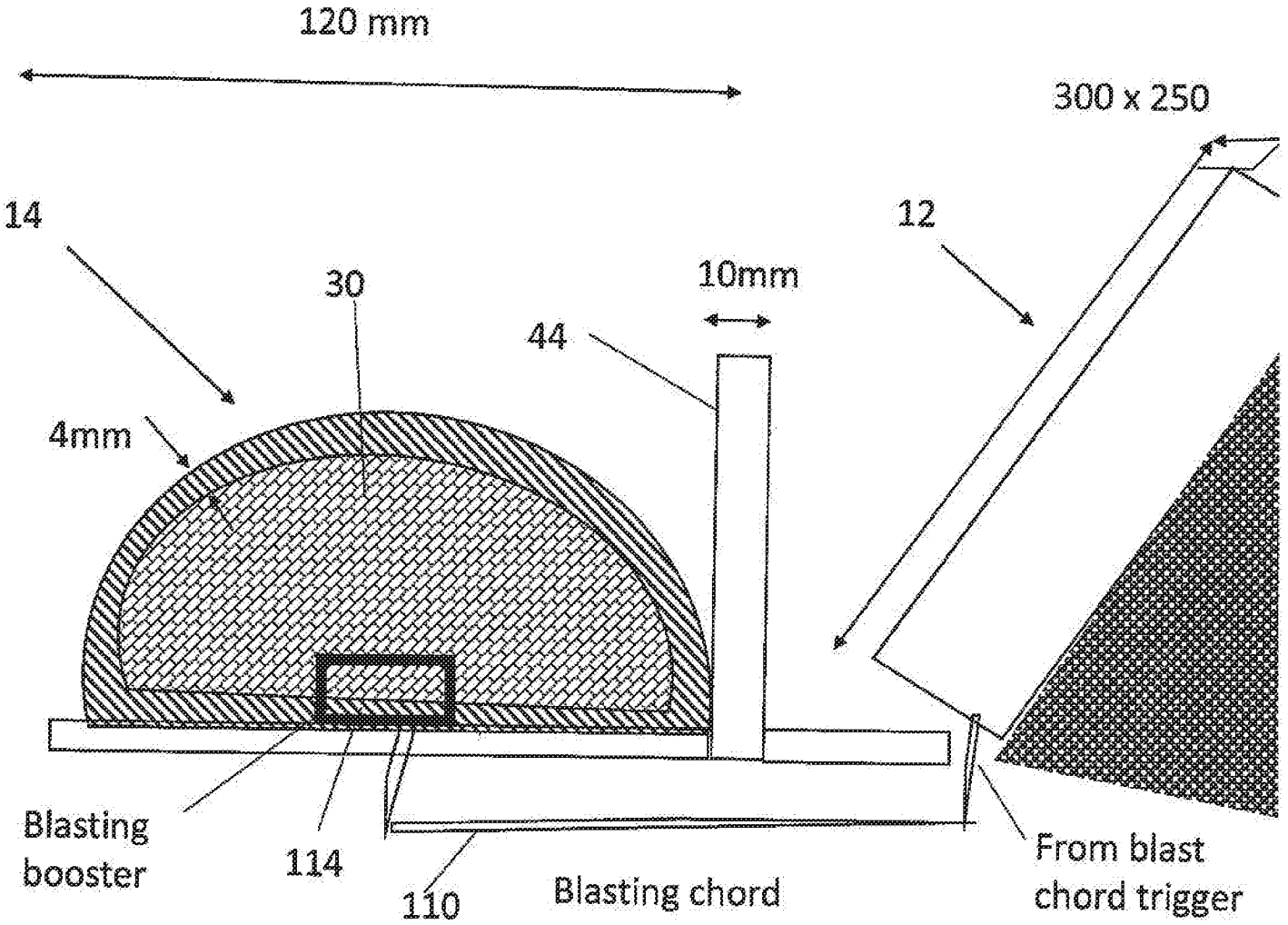
FIG. 19 is a variation of the embodiment of FIGS. 14A-B wherein a blasting cord is used in place of an electric wire.

Reference is now made to FIG. 19, which shows the two explosion centers 12 and 14 in greater detail. Shield 44 separates the domains of the two explosion centers so that the blasts do not interfere with each other and blasting cord 110 links the second explosion center 14 to the blast cord trigger. First explosion center 12 may be supported in its angled position by filler 112 which may be for example polystyrene.

The blasting cord is connected to blast booster 114 which detonates charge 30. Charge 30 may be encased in metal casing 68. A typical thickness for the casing is 4 mm, for the shield is 10 mm and the second explosion center may be 120 mm in length. The construction for the primary explosion center is typically 300×250 mm and the distance between the first and second explosion centers may be varied. The construction shown in FIG. 19 may be combined with any other embodiment herein.

Figure 20:
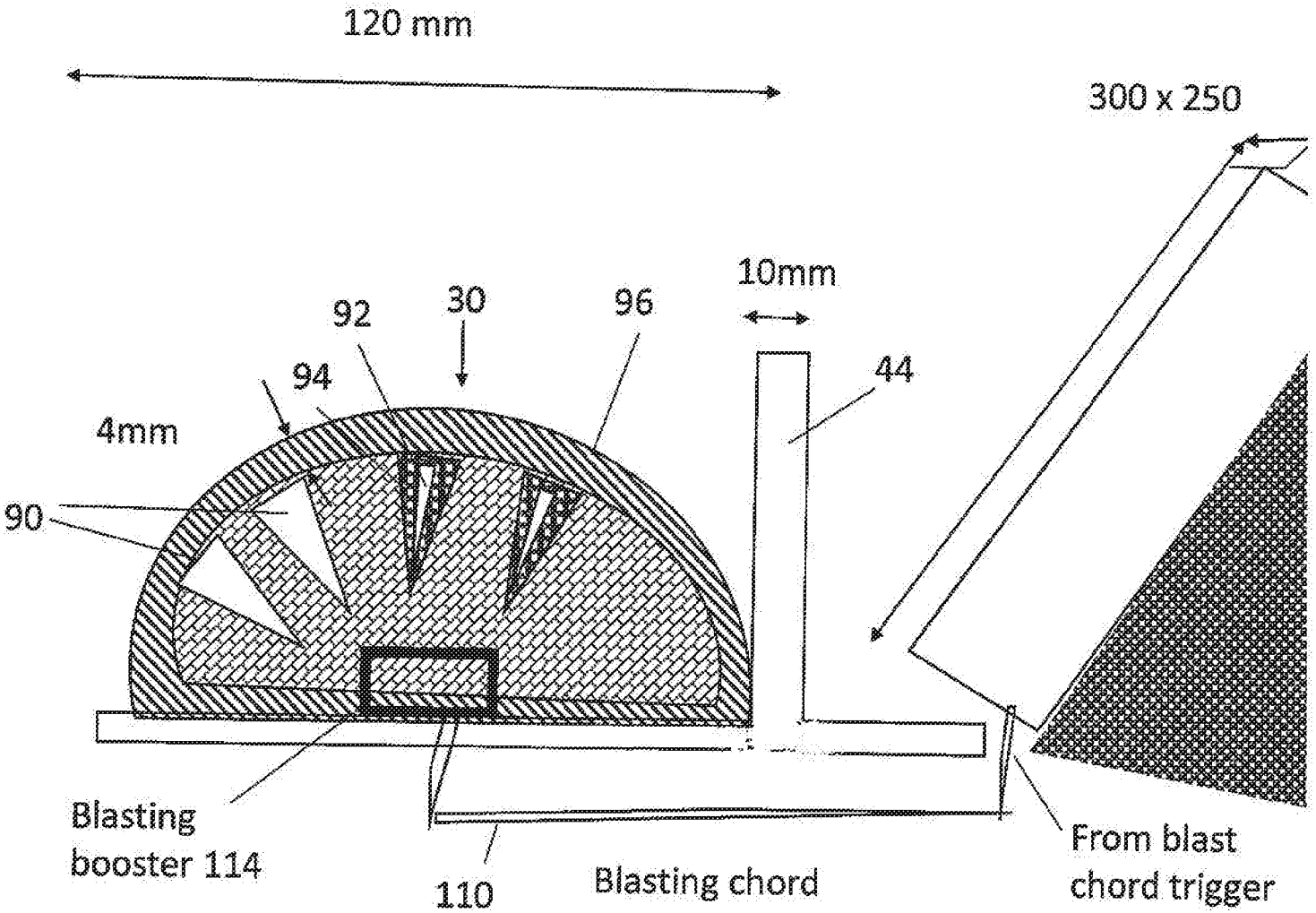
FIG. 20 is a variation of the embodiment of FIG. 19 in which the hemispherical charge of the second explosion center is shaped within a shell.

Referring now to FIG. 20, and the hemispherical charge 30 comprises one or more hollow sections 90 and 92. The hollow sections may be of the kind of formation that is typically used in shape charges. Hollow sections 90 are simply hollowed into the explosive. Hollowed sections 92 are lined with a metal liner 94. Lined and 20 unlined hollow sections may be provided exclusively, or may be provided together as shown. An outer shell 96, of metal, for example aluminum, encloses the hemisphere.

Here the shell is shown by way of example to be 4 mm in thickness. The metal used in the liner and that used in the shell may be the same, or, as illustrated, may be different. The liner may for example be copper.

The hemispherical charge of FIG. 20 may be used with any of the embodiments herein.

Figure 21:
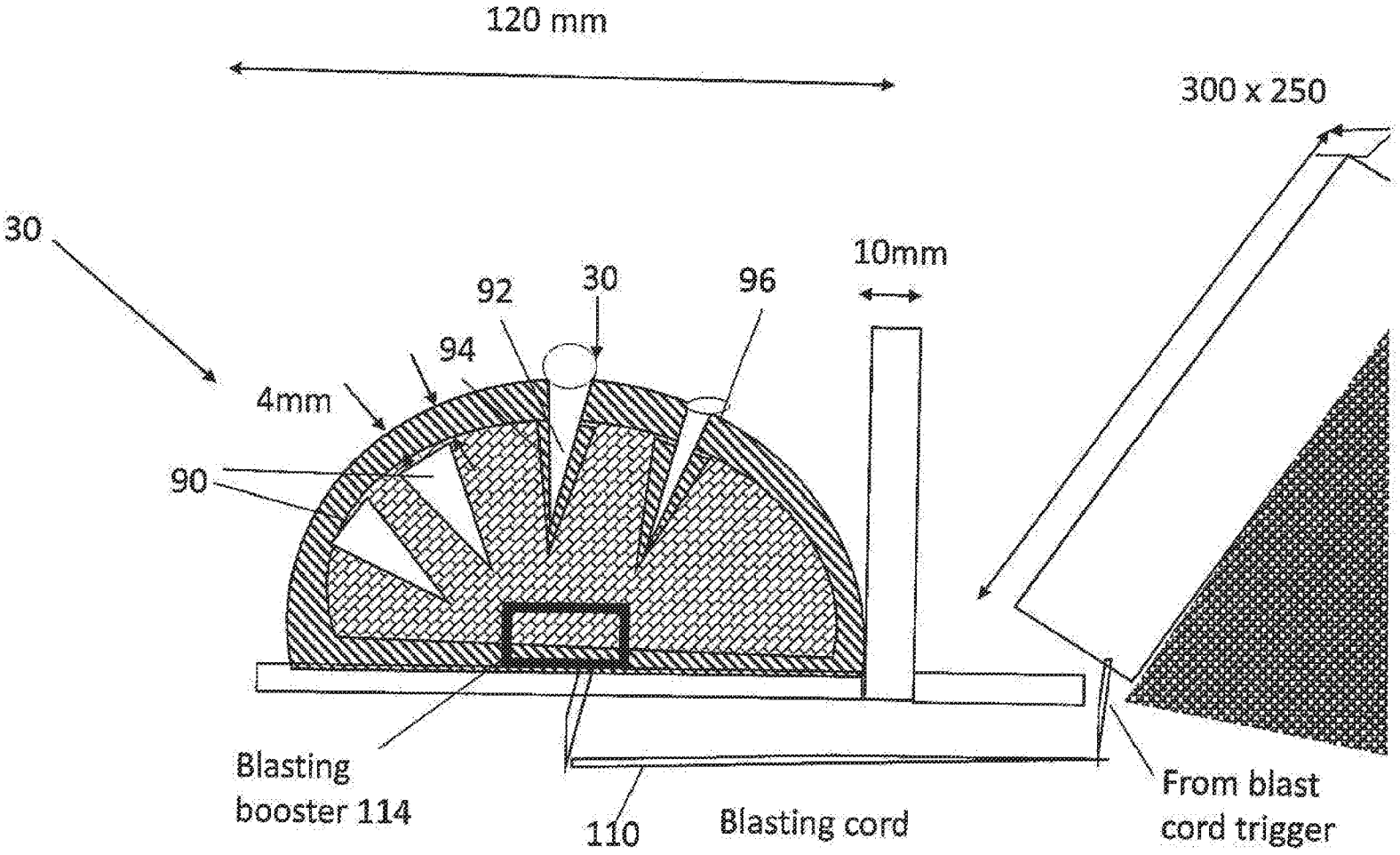
FIG. 21 is a variation of the embodiment of FIG. 20 in which the hemispherical charge is shaped with hollows within the shell and lined hollows exposed.

Referring now to FIG. 21, the shell 96 opens into the lined spaces of voids 92 to provide lined open voids in the explosive shape. The embodiment of FIG. 21 may be combined with any other embodiment herein. It is noted that lined and unlined 30 hollows may be provided in any combination and open and closed hollows may be provided in any combination.

Figure 22:
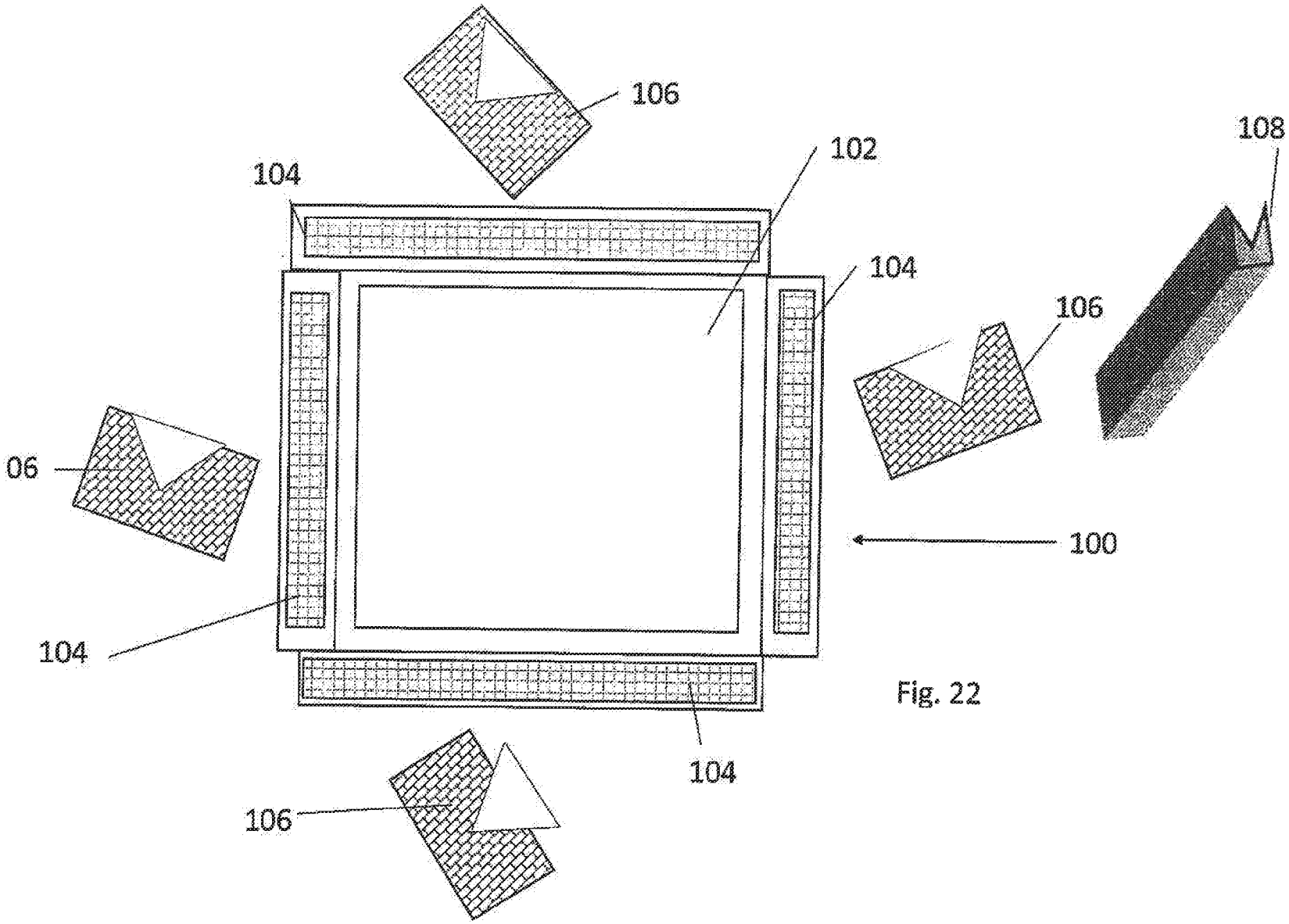
FIG. 22 is a view from above of an ERA with shaped charges arranged as a frame around a central plate according to embodiments of the present invention.

Reference is now made to FIG. 22, which is a simplified drawing of another ERA plate 100 according to an embodiment of the present invention, here seen from broad side that faces outwards when mounted on the tank etc. The reactive armor unit 100 is a rectangular box including central steel plates 102 which may be angled and may sandwich an explosive layer. Around the central steel plates are a number, typically four, lengths of shaped charges 104 arranged to form a frame around the central steel. Each length of shaped charge 104 is oriented differently—as shown in cross-sectional details 106, so as to provide four blasts in different directions to disrupt the incoming tandem warhead. The orientations may be selected to generate a region of contiguous protective effect in front of the ERA.

In an embodiment, the shaped charges may explode sequentially in a controlled manner. In an alternative, the shaped charges may be provided with different kinds of explosive that explode at different rates, for example setting up a prolonged effect.

The explosives may be augmented with particles that are ejected into the direction of the incoming missile.

Although the shaped charges are shown as wedges, the shaping could alternatively be rounded, say to form an explosive lens.

Detail 108 shows a perspective view of one of the lengths of shape charge 104. The ERA according to any of the present embodiments may be connected to a radar, or other available sensing system, which may provide advance warning of an incoming projectile and may align the parts of the ERA in a manner that is optimal for the expected strike, and/or activate parts as necessary.

In an embodiment, multiple ERA modules are attached to a given vehicle and the radar or other sensing system may select which of the different modules to operate.

Operation may be prior to or upon impact.

Alternatively, or additionally, individual modules may be connected to their own sensor units. In a further alternative, suitable control may ensure that a sequence of events is initiated using elements from several modules.

FIGS. 23A and 23B are lateral and longitudinal cross sections of steel plates that may be used in the present embodiments. In the plates 200, steel 202 forms an embedding for blocks of ceramic 204.

In the present disclosure, the terms "comprises", "comprising", "includes", "including", "having" and their conjugates mean "including but not limited to".

The term "consisting of" means "including and limited to".

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A reactive armor unit comprising a first explosion center and a second explosion center, the unit being configured with a predetermined distance between the first and the second explosion centers, the predetermined distance being selected such that the second explosion center is located behind an initial detonation of an incoming tandem warhead relative to an incoming direction of said tandem warhead, wherein said second explosion center is mounted on a movable element to extend away from said reactive armor unit to a second predetermined distance from said first explosion center.

2. The reactive armor unit of claim 1, further comprising a shield element between the first explosion center and the second explosion center.

3. The reactive armor unit of claim 1, wherein said movable element is controllably movable between said predetermined distances.

4. The reactive armor unit of claim 1, having a first state in which said second explosion center is extended outwards on said movable element and a second state in which said second explosion center is withdrawn into said reactive armor unit.

5. The reactive armor unit of claim 1, further comprising a third explosion center at a third predetermined distance from said first explosion center and at a fourth predetermined distance from said second explosion center.

6. The reactive armor unit of claim 5, wherein said third explosion center is mounted on a movable element to extend outwards of said reactive armor unit to a fifth predetermined distance from said first explosion center, or wherein said third explosion center is on said movable element at a sixth predetermined distance along said moving element from said second explosion center.

7. The reactive armor unit of claim 1, further comprising a trigger mechanism for activation by an incoming warhead, and a delay mechanism configured to define respective predetermined delays to each of said explosion centers.

8. The reactive armor unit of claim 7, wherein at least one of said predetermined delays is selected to ensure that at least one of said explosion centers is timed to explode at a time suitable for disruption of pressure wave formation or structural integrity of a secondary detonation of said incoming tandem missile.

9. The reactive armor unit of claim 7, wherein said delay mechanism comprises one member of the group consisting of: a predetermined length of explosive cord, an electronic timer, a length of high explosive and a tube of high explosive.

10. The reactive armor unit of claim 7, wherein at least one of said predetermined distances is selected to ensure that at least one of said explosion centers is located behind a primary detonation of an incoming tandem missile and in a position suitable for disruption of pressure wave formation or structural integrity of a secondary detonation of said incoming tandem missile.

11. The reactive armor unit of claim 7, having a first surface for orientation parallel to armor being protected, wherein said first explosion center comprises first and second sheets of steel placed at an acute angle to said first surface, or having an outer surface following a contour defined by said first and second sheets of steel at said acute angle.

12. The reactive armor unit of claim 11, said predetermined distance being defined by an outer extension extending from said first surface to accommodate said second explosion center.

13. The reactive armor unit of claim 12, further comprising an opening to allow an explosion center to be extended outwardly therefrom.

14. The reactive armor unit of claim 12, wherein at least one of said explosion centers comprises a hemispherical charge.

15. The reactive armor unit of claim 14, wherein said hemispherical charge comprises at least one member of the group consisting of:

at least one hollow section;

a metal shell;

a metal shell enclosing at least one hollow section; and at least one hollow section lined with a metal liner;

a metal shell comprising a first metal around an outer contour of said charge and a second metal different from said first metal.

16. The reactive armor unit of claim 12, comprising a first surface for placing flush on armor to be protected and having a plurality of lengths of shaped charges, each length of shaped charge being oriented differently with respect to said first surface, said orientations being selected to create a contiguous area of self-defense in front of said unit.

17. The reactive armor unit of claim 1, comprising a shield element in between said first explosion center and said second explosion center, the shield element being positioned to shield said second explosion center from a blast of said first explosion center thereby to isolate explosions of each explosion center.

18. The reactive armor unit of claim 17, having a first surface for orientation parallel to armor being protected, and a first explosion center comprising sheets of steel placed at an acute angle to said first surface, the reactive armor unit further having an outer facing surface following a contour defined by said sheets of steel at said acute angle.

* * * * *